United States Patent [19]

Hasenkamp

[11] Patent Number: 4,807,350

[45] Date of Patent: Feb. 28, 1989

[54] METHOD FOR BINDING COILS

[75] Inventor: Friederich Hasenkamp, Nettetal, Fed. Rep. of Germany

[73] Assignee: Metallverarbeitung Breyell-Dinslaken GmbH, Nettetal, Fed. Rep. of Germany

[21] Appl. No.: 936,210

[22] Filed: Dec. 1, 1986

[30] Foreign Application Priority Data

Dec. 11, 1985 [DE] Fed. Rep. of Germany ..... 3543692

[51] Int. Cl.[4] ..... B65B 13/02

[52] U.S. Cl. ..... 29/430; 53/399; 100/14; 414/786

[58] Field of Search ..... 29/430, 791, 792, 822; 53/176, 582, 234, 399, 449; 100/2, 5, 14; 414/786

[56] References Cited

U.S. PATENT DOCUMENTS

| | | | |
|---|---|---|---|
| 2,617,353 | 11/1952 | Ranney | 100/2 |
| 2,700,332 | 1/1955 | Donald | 100/2 |
| 3,147,691 | 9/1964 | Hogsten | 100/2 |
| 3,306,426 | 2/1967 | Arnold et al. | 29/822 X |
| 3,379,121 | 4/1968 | Lems | 100/2 |

FOREIGN PATENT DOCUMENTS

| | | | |
|---|---|---|---|
| 262932 | 11/1949 | Netherlands | 53/582 |

*Primary Examiner*—P. W. Echols
*Assistant Examiner*—Joseph M. Gorski
*Attorney, Agent, or Firm*—Jordan and Hamburg

[57] ABSTRACT

Method and an apparatus for binding coils, for example, of sheet steel, which enable the whole process, from the formation of the coils to the completion of the ready-to-be-shipped bound coils, to be automated. Provision is made so that the strips, produced in a slitting line for example, in each case are coiled in coaxially aligned groups and, while their free severed ends in each case are held down, they are collected. Each collected group of coils, while retaining the coaxial alignment and the holding down of the severed ends, are moved into a transfer position, from which the coils, while the respective severed end continues to be held down, are isolated cyclically and transferred into an operating cycle passing through a first and a second binding position as well as a removal position, one or several additional groups of coils being collected while the coils are being worked off cyclically.

10 Claims, 3 Drawing Sheets

12
10
8
11
13
14
17
19
18
16
15
k
p
n
m

METHOD FOR BINDING COILS

The invention relates to a method and to an apparatus for binding coils, for example, of sheet steel. "Binding" is understood to include strapping, that is, binding in the circumferential direction, as well as transverse binding, that is binding in the radial direction.

It is an object of the invention to provide a method and an apparatus which enable the whole process of forming the coils up to the completion of the ready to be shipped, bound coils to be simplified and automated, so that only one supervising person is required to carry out the work cycles from one control post.

The invention accomplishes the objective in an optimum fashion because it makes do with extremely short cycle times.

The object of the invention is explained in greater detail below by means of an example of the operation of the inventive apparatus, which is shown schematically in the drawings.

DESCRIPTION OF THE PREFERRED EMBODIMENTS

Figure 1:
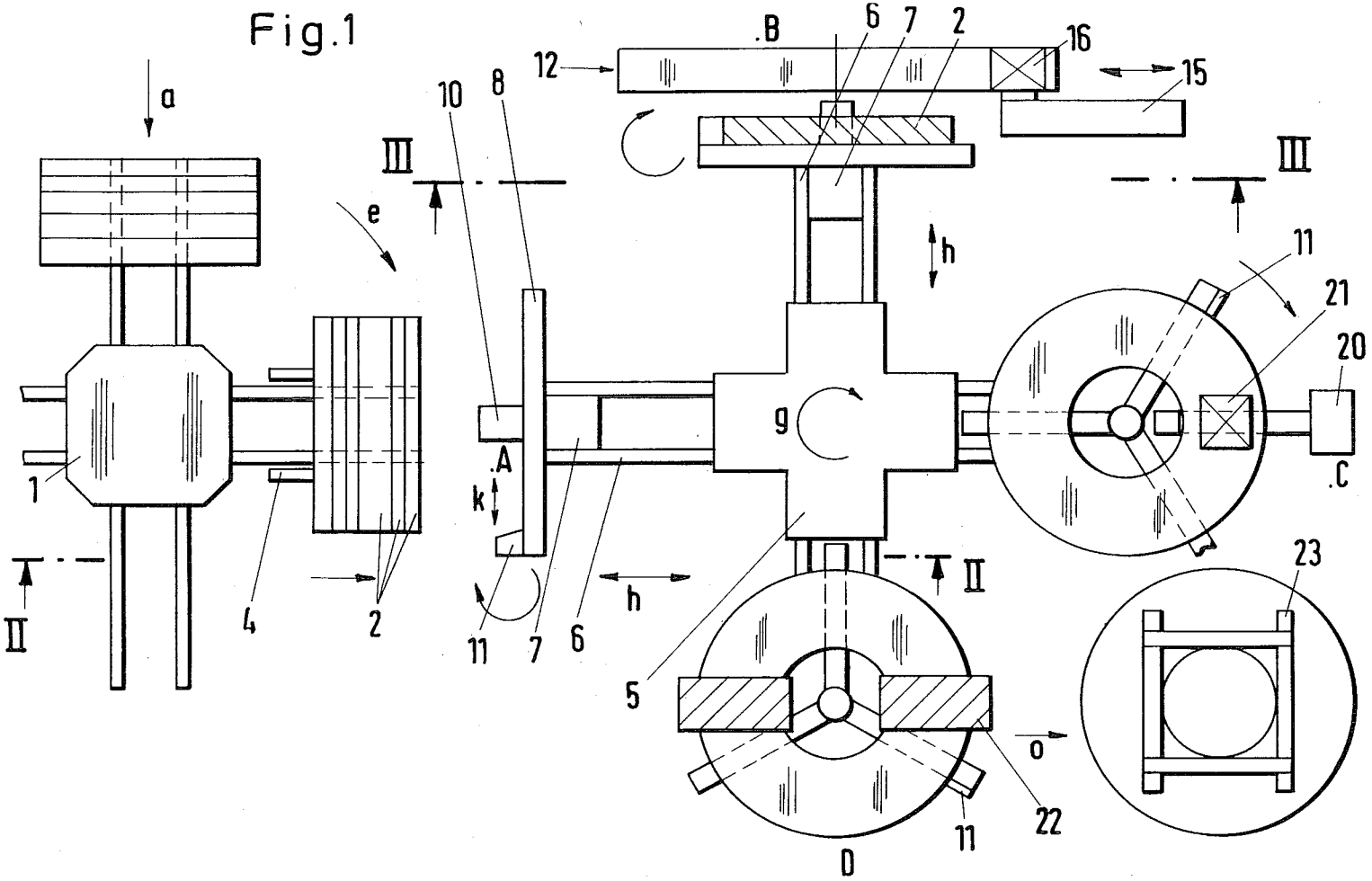
FIG. 1 is a plan view of one embodiment of the inventive apparatus.

As is evident first of all from FIG. 1, the apparatus comprises, as a first device, a collecting turnstile 1, which can be rotated about a vertical axis and has at least two and, as shown in the drawing, preferably however four horizontal arms and on which the flat strip, produced on a slitting line, rolling machine or the like (not shown) and coiled into coils of different or the same width, can be collected successively as a group or bundle of coaxially arranged coils 2. For the coiling, a coil or bundle lift truck (not shown) can be provided with a strip guide, which functions as a mobile coiler and from which the coils 2, which are formed, are supplied individually or as a group or bundle in the direction of arrow a to the collecting turnstile 1. Moreover, a strip guide 3 (FIG. 2), movable radially in the direction of arrow b as well as axially in the direction of arrow c with respect to the vertical axis of rotation of the collecting turnstile 1 by means of an individual drive, is provided above each arm of the collecting turnstile 1 and holds down the severed ends of the coiled coils 2 individually, so that these ends need not be fastened, for example, by gluing.

Figure 2:
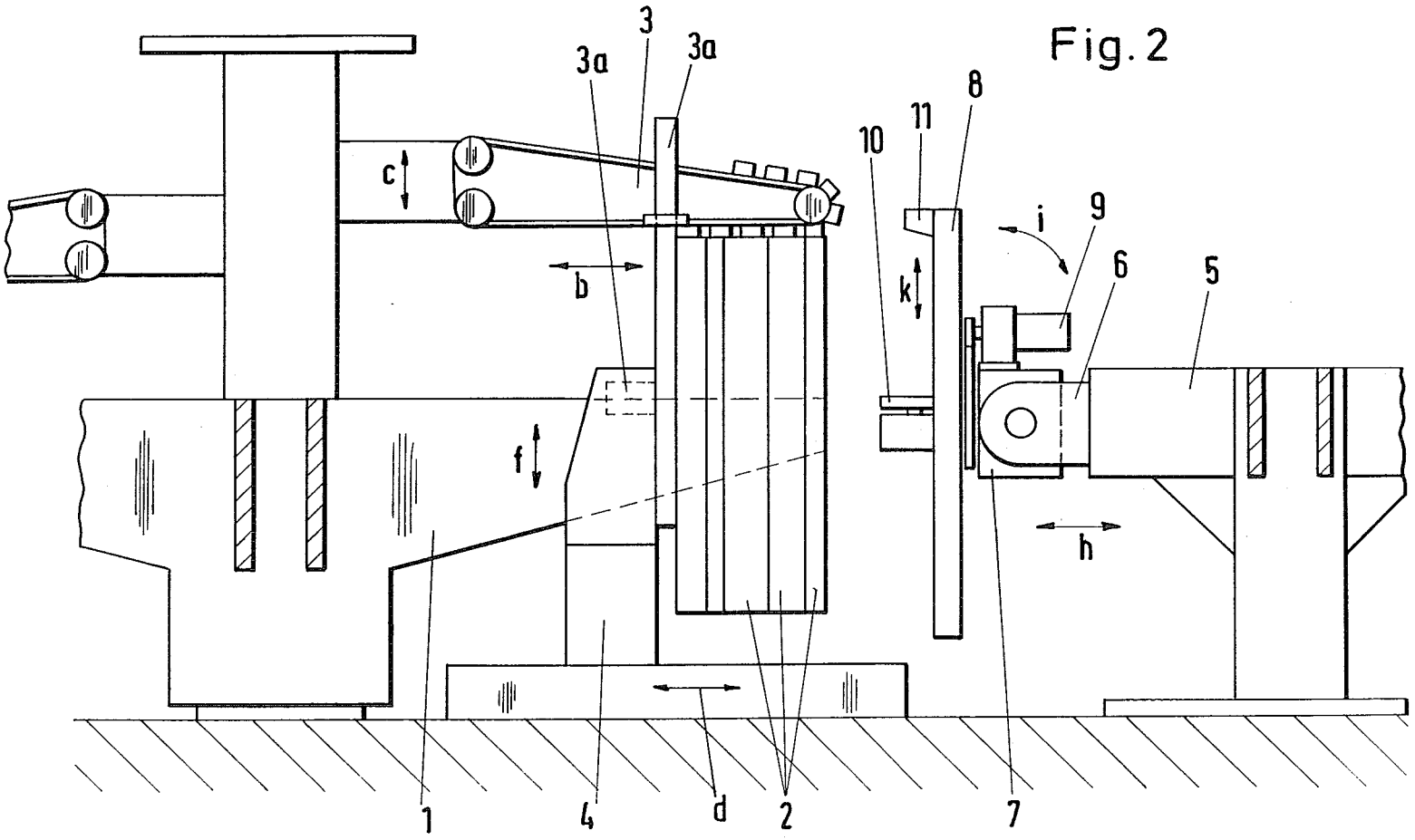
FIG. 2 is a partial side view of the region of the apparatus taken along II—II in FIG. 1.

If there is a complete group or a complete bundle of coils 2 on one arm of the collecting turnstile 1 in the collecting position (arrow direction a), the collecting turnstile is turned in the direction of arrow e by 90° (FIG. 1) into a transfer position, in which there is a stripping device 4, which can be moved horizontally back and forth in the direction of arrow d and also up and down in the direction of arrow f and which catches hold of the group or the bundle of coils 2 on the arm of the collecting turnstile 1, in order to strip it axially. The strip-guide catch 3*a*, provided on the stripping device 4, serves to move also the strip guide 3 in the direction of arrow b by an appropriate distance during an advance (FIG. 2).

As is furthermore evident from FIG. 1, the apparatus also comprises, as a second device, a turnstile 5, which can also be rotated about a vertical axis in the direction of arrow g and passes cyclically though different operating positions A, B, C, D. The number of arms 6 of the turnstile 5 corresponds to the number of operating positions A, B, C and D, that is, four in the present case. They are constructed in each case as sliding blocks, which can be moved forwards and backwards horizontally in the direction of arrow h. The turnstile 5 with its arms 6, in conjunction with the number of operating positions, is so designed and, with respect to the collecting turnstile 1, so disposed that, after each motion of the turnstile, a free arm 6 of the same is opposite the arm of the collecting turnstile, which is in the transfer position with a bundle or a group of coils 2 for the direct direct take-over of an isolated coil 2. This is evident particularly from FIG. 2, which illustrates the transfer position A.

Each of the longitudinally displaceable arms 6 of the turnstile 5 has a tilting joint 7 at its outer end, said tilting joint carrying a turntable 8, which is formed by arms, which are disposed in stellate fashion relative to one another and advisably are provided with holding magnets. By means of the tilting joint 7 and an activating device assigned to this, the turntable 8 can be tilted in the direction of arrow i from a vertical position into a horizontal position and in the reverse direction. A motor 9, which is mounted on the tilting joint 7 and which follows the movement of this tilting joint 7, is coupled operationally with the turntable 8 and enables it to be rotated in a vertical as well as in a horizontal position. Centrally, the turntable 8 has an axially projecting holding arbor 10, which advisably is constructed as an expanding arbor. At least one of the arms of each turntable 8 is provided with a retaining finger 11, which is adjustable radially in the direction of arrow k and projects outwards and forwards from the table plane.

The mode of action, in detail, is as follows.

Starting out from the transfer position A shown in FIG. 2, the turntable 8, which is in the vertical position, is moved forwards by means of the longitudinally displaceable arm 6 of the turnstile 5 in coaxial alignment of the holding arbor 10 with the arm of the collecting turnstile 1 against this arm, until the foremost coil 2 can be pushed by means of the stripping device 4 onto the the holding arbor 10 and comes up against the arms of the turntable 9. An appropriate sensor control ensures that in each case only the foremost coil 2 on the arm of the collecting turnstile 1 reaches, by means of the stripping device 4, the holding arbor 10 and thus the turntable 8 of the turnstile 5. During the transfer of the coil 2 from the arm of the collecting turnstile 1 to the turntable 8 of the turnstile 5, the retaining finger 11 moves in the direction of the strip guide 3 and, after appropriate adjustment in the direction of the arrow k, assumes its function with respect to holding down the severed end of the foremost coil 2, while the strip guide 3 moves corresponding to the forward motion of the stripping device 4 and of the strip guide catch 3*a* by a measure corresponding to the width of the coil 2 radially towards the outside away from the axis of the collecting turnstile 1 and thus releases the foremost coil. In this manner, the isolated transfer of the in each case foremost or outermost coil 2 from the arm of the collecting turnstile 1 to the turntable 8 of the turnstile 4 is achieved, while the severed end is being held down, this being achieved without requiring any means of fastening the severed end.

Figure 3:
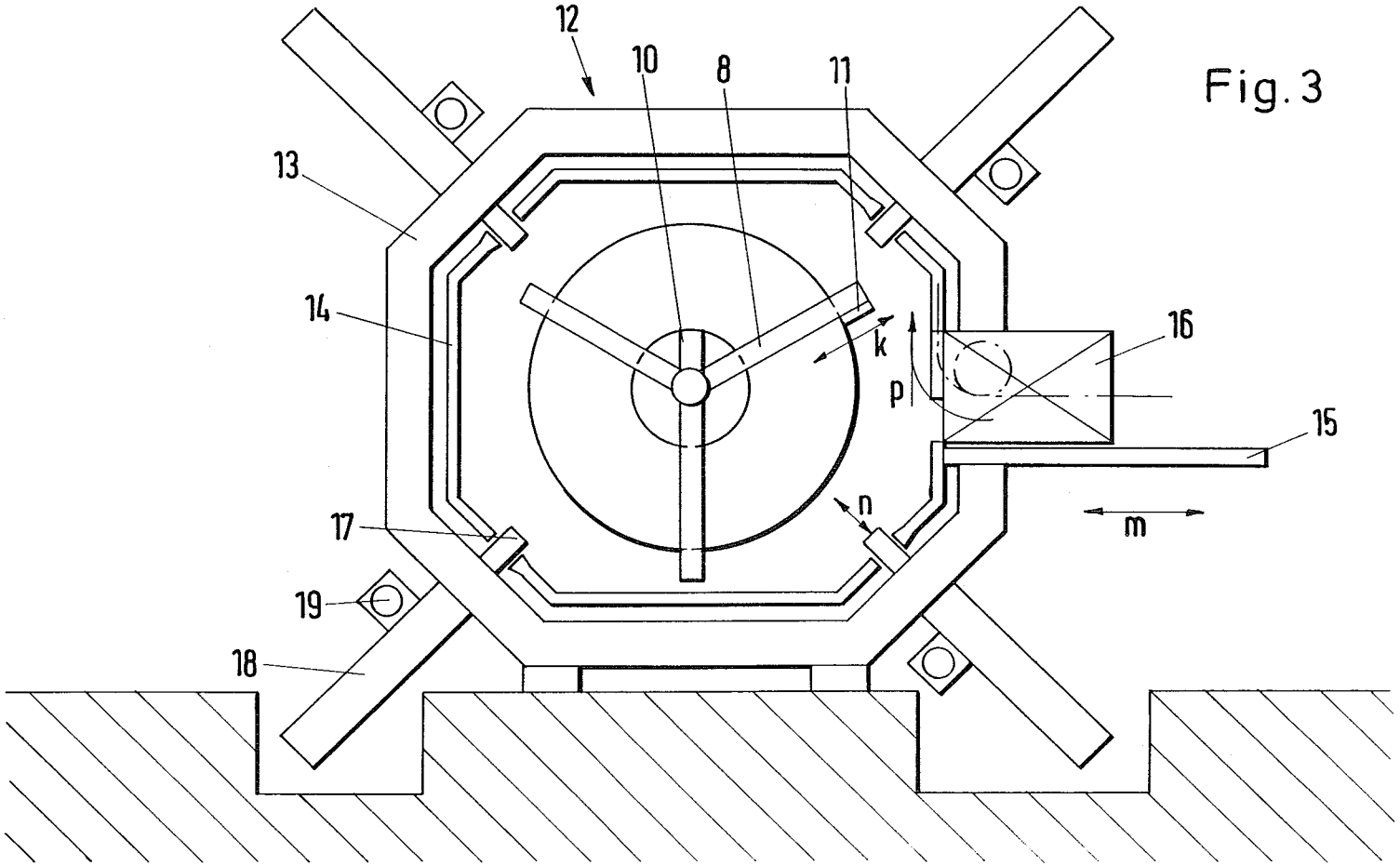
FIG. 3 is a fine detail elevational view taken along line III—III in FIG. 1.

After the transfer of a coil 2 to the turntable 8, the sliding arm 6 of said turntable is moved a little in a radial direction inwards and the turnstile 5 is swivelled through 90°, as a result of which the turntable 8 and the coil 2, which is on the turntable 8 and is centered by the holding arbor 10 and held down with respect to the severed end by means of the retaining finger 11, reach the operating position B, in which the strapping of the coil 2 takes place in a device, which is labelled 12 as a whole. Simultaneously with this, a new isolation and transfer of a further coil 2 takes place in the operating position A with the next turntable of the turnstile 5, which has been rotated to there. As can be seen from FIG. 3, the strapping device 12 consists essentially of an octagonal machine frame 13 with an appropriately constructed inner strip guide 14 and a binding head 16, which is displaceable in the direction of arrow m by means of a guide slit 15. So far, the strapping device 12 is known and therefore also requires no further explanation. The turntable 8 with the coil 2, brought into position B, is moved by means of the longitudinally displaceable arm 6 of the turnstile 5 into the strapping device 12 and, moreover, in such a manner, that the strapping in each case takes place over the middle of the periphery, even if the width of the respective coil 2 varies. On the one hand, to achieve that the coil 2 is held fast or is fixed during this strapping process and, on the other, to ensure that the strapping tape, pushed through the strip guide 14 in the direction of arrow p, is installed radially and centrally on the coil 2, special tape guides 17 are provided, through which the binding tape, which has been pushed through, receives restricted guidance on tensioning. The tape guides 17 are disposed in radial orientation in the interior of the machine frame 13 and are movable in the direction of arrow n, and moreover independently of the strip guide 14, which in each case is interrupted in the area of the of the tape guide 17. To achieve this mobility of the tape guide 17, guide tubes 18 may be provided on the outside of the machine frame 13, as shown in FIG. 3. In these guide tubes 18, toothed bar racks, which can be shifted longitudinally, are activated in each case by means of a hydraulic motor 19 and therewith move the respective tape guide 17 in the direction of arrow n as a part, formed at the end of the toothed bar racks and penetrating the machine frame.

It should still be mentioned that, after the tape guides 17 are moved forwards against the periphery of the coil 2 in the strapping device 12, the periphery is held fast between the tape guides, so that the retaining finger 11 on the turntable 8, which previously held the severed end down, can cease to function; it is raised by a radially outwards directed motion of the coil and folded out of the way towards the outside by means of a traversing cylinder, so that the strapping process can take place without being impeded hereby by by tightening the binding head 16.

After the strapping process and the radial motion backwards of the turntable 8 from the strapping device 12, the turnstile 5 is rotated once again through 90° and, simultaneously with this, the turntable 8 is swivelled by means of the tilting joint 7 from the previously vertical position into the horizontal position. The coil 2, with its turntable 8, now is in a horizontal position in operating position C. It is bound twice or three times here in the transverse direction, that is, also radially in addition to the strapping at the periphery, by means of a transverse binding device 20 with binding head 21, which is known per se and therefore does not require a more detailed explanation. Simultaneously with this, strapping of a further coil takes place in operating position B and a further isolation and transfer of a coil to a turntable 8 of the turnstile 5 takes place in operating position A.

After the turnstile is rotated once more through 90°, the strapped and transversely bound coil with its turntable, which continues to be aligned horizontally, reaches the operating position D, in which the bound coil is lifted off by means of a magnetic or grapple claw lifting device 22 from turntable 9 and and moved sideways in the direction of arrow o and stacked on pallets 23 together with other coils that are ready to be shipped. Instead of pallets 23, it is also possible to provide tilting tables for the upright storage of the finished coils.

On rotating the turnstile 5 further once more by 90°, the turntable migrates from the removal position D once again into the transfer position A. At the same time, it is swung from its horizontal position back into the vertical position. The turntable thus is ready once again for a further isolation and transfer process and the cycle commences anew.

In those cases, in which strapping of the coils is not required, and this depends on the size or the nature of the material of the coils, the strapping device 12 is switched off, so that the coil is not bound in position B; instead, it is bound for the first time once or twice in the transverse direction in the transverse binding device 20 in operating position C. In this case, the retaining finger 11 on turntable 8 remains in the pressing position, until the transverse binding process has taken place.

Owing to the fact that the inventive device operates over four operating positions, four operating steps are carried out simultaneously, namely the isolation and transfer of the coils in position A, the strapping in position B, the transverse binding in position C and the removal and stacking in position D, so that extremely short cycle times result. The bundles of coils 2 on collecting turnstile 1 can thus be "worked off" so rapidly, so that, depending on the number and width of the coils, the collecting turnstile can thus fulfill the function of a buffer and that, with that, the total process of working up flat strip, coming from a slitting line, rolling machine or the like into coils, which are ready to be shipped, can be carried out fully automatically without any interim storage and requires supervision by only one person from a control post. It is, moreover, of particular importance that the severed ends of the strips no longer need to be fastened and thus are not damaged; instead, the coils of a group or bundle can in each case be isolated and then bound without the ends being fastened.

I claim:

1. A process for binding material which has been coiled into generally cylindrical coils each having an axis and in which the outer circumference of the coiled material has a free end, comprising transferring coils to a transfer station while engaging and holding down said free end of said coil which is being transferred, transferring said coil from said transfer station to a first binding station while continuing to engage and hold down said free end of said coil, binding said coil with a first binding material at said first binding station, transferring said coil from said first binding station to a second binding station, binding said coil with a second binding material at said second binding station, transferring said bound coil from said second binding station to a removal station and removing said bound coil from said removal station, said transfer at said transfer station, said binding steps at said first and second binding stations, and said removal at said removal station being simultaneously operable such that a plurality of coils are thereby bound upon passing progressively from said transfer to said removal station, wherein said step of engaging and holding down is performed by mechanical means.

2. A process according to claim 1, wherein said step of binding said coil at said first binding station comprises wrapping said first binding material about said coil in a first direction, said step of binding said coil at said second binding station comprising wrapping said second binding material about said coil in a second direction which is generally transverse to said first direction.

3. A process according to claim 1, wherein said step of transferring said coil to said transfer station and said step of transferring said coil to said first binding station comprises maintaining said coil with its axis horizontally disposed during the transferring of the coil to said transfer station and to said first bonding station, the process further including the step of turning said coil so that its axis is vertically disposed, maintaining said coil with its axis vertically disposed as said coil is bound at said second binding station and as said coil is transferred to said removal station, said turning step being effected after said binding step at said first binding station and before said binding step at said second binding station.

4. A process according to claim 1, wherein step of transferring said coil to said transfer station comprises moving said coil in a direction parallel to the axis of said coil from a horizontally disposed arm of a first turnstile means to a horizontally disposed arm means of a second turnstile means, said step of engaging and holding down said free end of the coil during said transfer to said transfer station comprising engaging and holding down said free end utilizing two different engaging and holding down means, one of which is on said first turnstile means and the other of which is on said second turnstile means.

5. A process according to claim 1 further comprising moving said coils radially relative to the axis of rotation of said second turnstile as said coil is moved between said transfer station and said first binding station.

6. A process according to claim 1, wherein said transfer station, said first and second binding stations, and said removal station are equally spaced from one another about a vertical axis.

7. A process according to claim 1 further comprising cyclically and automatically transferring said coils to said transfer station, to said first and second binding stations, and to said removal station such that for each cycle of operation, an unbound coil is automatically transferred at said transfer station and a bound coil is automatically removed from said removal station.

8. A process for binding material which has been coiled into generally cylindrical coils each having an axis and in which the outer circumference of the coiled material has a free end, comprising disposing a coil with its axis horizontally disposed on a horizontally disposed first arm, engaging and holding down said free end of said coil on said first arm, moving said coil in a first moving step in a horizontal direction parallel to the axis of said coil from said first arm to a horizontally disposed second arm of a turnstile, engaging and holding down said free end of said coil during said first moving step, moving said coil in a second moving step along a circular path by rotating said turnstile to a first binding station, engaging and holding down said free end of said coil as said coil is moved during the second moving step, binding said coil with a first binding material at said first binding station, moving said coil during a third moving step from said first binding station to a second binding station, binding said coil with a second binding material at said second binding station, moving said bound coil during a fourth moving step from said second binding station to a removal station, moving said bound coil during a fifth moving step from said second arm, and effecting said first to fifth moving steps simultaneously such that a plurality of said coils are thereby bound as a plurality of said coils are moved simultaneously through said first to fifth moving steps, wherein said step of engaging and holding down is performed by mechanical means.

9. A process for binding material which has been coiled into generally cylindrical coils each having an axis and in which the outer circumference of the coiled material has a free end, comprising transferring coils to a transfer station while engaging and holding down said free end of said coil which is being tranferred, transferring said coil from said transfer station to at least one binding station while continuing to engage and hold down said free end of said coil, binding said coil with binding material at said at least one binding station, transferring said coil from said at least one binding station to a removal station and removing said bound coil from said removal station, said transfer at said transfer station, said binding step at said at least one binding station, and said removal at said removal station being simultaneously operable such that a plurality of coils are thereby bound upon passing progressively from said transfer to said removal station, wherein said step of engaging and holding down is performed by mechanical means.

10. A process for binding material which has been coiled into generally cylindrical coils each having an axis and in which the outer circumference of the coiled material has a free end, comprising disposing said coil with its axis horizontally disposed on a horizontally disposed first arm, engaging and holding down said free end of said coil on said first arm, moving said coil in a first moving step in a horizontal direction parallel to the axis of said coil from said first arm to a horizontally disposed second arm of a turnstile, engaging and holding down said free end of said coil during said first moving step, moving said coil in a second moving step along a circular path by rotating said turnstile to at least one binding station, binding said coil with a binding material at said at least one binding station, moving said coil during a third moving step from said at least one binding station to a removal station, removing said bound coil during a fourth moving step from said second arm, and effecting said first to fourth moving steps simultaneously such that a plurality of said coils are thereby bound as a plurality of said coils are moved simultaneously through said first to fourth moving steps, wherein said step of engaging and holding down is performed by mechanical means.

* * * * *